US006238322B1

(12) United States Patent
Hsu

(10) Patent No.: US 6,238,322 B1
(45) Date of Patent: May 29, 2001

(54) EXERCISE MACHINE HAVING A SLIDING SEAT SELECTIVELY COUPLED TO A SLIDING DAMPING MEMBER

(76) Inventor: Hank Hsu, 8F-14, No. 16, Lane 609, Sec. 5, Chung Hsin Rd., Sanchung (TW)

( * ) Notice: Subject to any disclaimer, the term of this patent is extended or adjusted under 35 U.S.C. 154(b) by 0 days.

(21) Appl. No.: 09/376,339

(22) Filed: Aug. 18, 1999

(51) Int. Cl.[7] ..... A63B 21/02; A63B 21/16

(52) U.S. Cl. ..... 482/96; 482/130; 482/72; 482/123; 482/135; 482/142

(58) Field of Search ..... 482/72, 96, 123, 482/130, 135, 142, 51, 126, 95, 122, 101, 70

*Primary Examiner*—Justine R. Yu
*Assistant Examiner*—Victor Hwang
(74) *Attorney, Agent, or Firm*—Browdy & Neimark

(57) ABSTRACT

An exercise machine comprises a frame on which a load mechanism and a sliding seat pad are mounted. The load mechanism is formed of a damping member and a slide member fastened with the damping member. The sliding seat pad has a link portion. The slide member is provided with a traction portion capable of coupling and uncoupling with the link portion of the sliding seat pad. The frame is further provided with a pull cord capable of pulling the sliding seat pad to displace at the time when the pull cord is pulled.

7 Claims, 8 Drawing Sheets

EXERCISE MACHINE HAVING A SLIDING SEAT SELECTIVELY COUPLED TO A SLIDING DAMPING MEMBER

FIELD OF THE INVENTION

The present invention relates generally to an exercise machine, and more particularly to an exercise machine for building muscles.

BACKGROUND OF THE INVENTION

As shown in FIG. 1, a muscle-building exercise device of the prior art comprises a frame 1 which is provided with a slide member 2 connected with a plurality of elastic members 3 having a damping effect. The slide member 2 can be kept at a first position which is located at the front section of the frame 1. The slide member 2 is further connected with a pull cord 4 which can be pulled to locate the slide member 2 at the second position opposite to the first position. The exercise effect is brought about by pulling repeatedly the pull cord 4 so as to cause the slide member 2 to slide back and forth on the frame 1. The magnitude of the exercise effect can be adjusted by increasing or decreasing the number of the elastic members 3.

SUMMARY OF THE INVENTION

It is the primary objective of the present invention to provide an exercise machine comprising a frame which is provided thereon with a sliding seat pad, a slide member, and a pull cord. The sliding seat pad can be connected with the slide member and actuated by the pull cord to move back and forth on the frame. When the sliding seat pad is connected with the slide member, the exercise machine is provided with a damping effect.

It is another objective of the present invention to provide an exercise machine comprising a frame which is slantingly disposed to enable the sliding seat pad to slide on the frame by the pulling force at such time when the sliding seat pad is not connected with the slide member.

In keeping with the principle of the present invention, the foregoing objectives of the present invention are attained by an exercise machine comprising a frame of a predetermined length and having a load mechanism to provide a slide member with a load. The slide member is capable of sliding back and forth between a first position and a second position on the frame. The frame is further provided with a pull cord. The sliding seat pad is mounted on the frame and provided in the underside thereof with a slide wheel. When the pull cord is pulled, the sliding seat pad is actuated to slide back and forth between the first position and the second position on the frame. The sliding seat pad is provided with a link portion. The slide member is provided with a traction portion capable of being coupled with the link portion of the sliding seat pad.

DETAILED DESCRIPTION OF THE INVENTION

Figure 1:
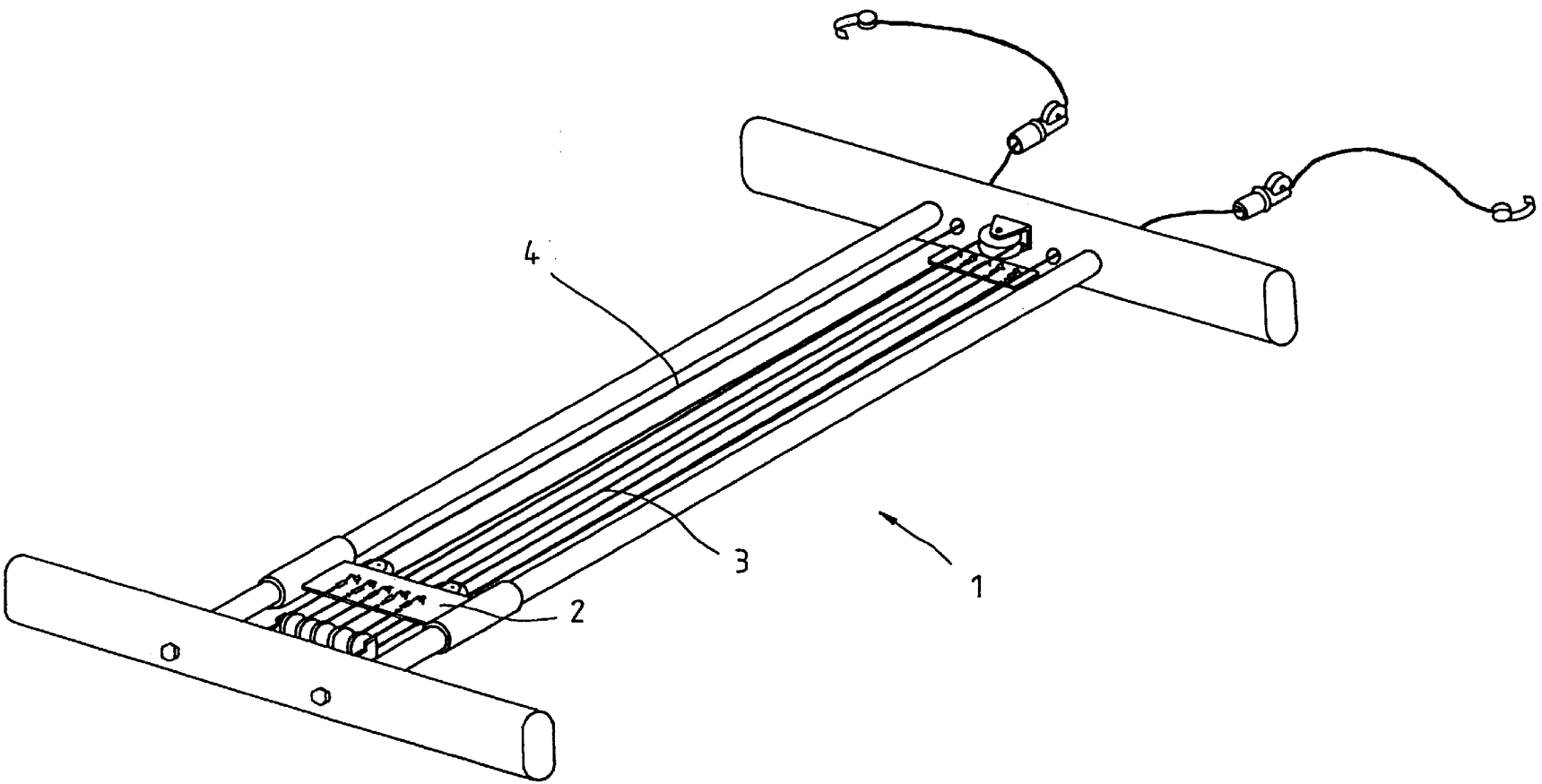
FIG. 1 (PRIOR ART)
FIG. 1 shows a perspective view of a muscle-building machine of the prior art.
Figure 2:
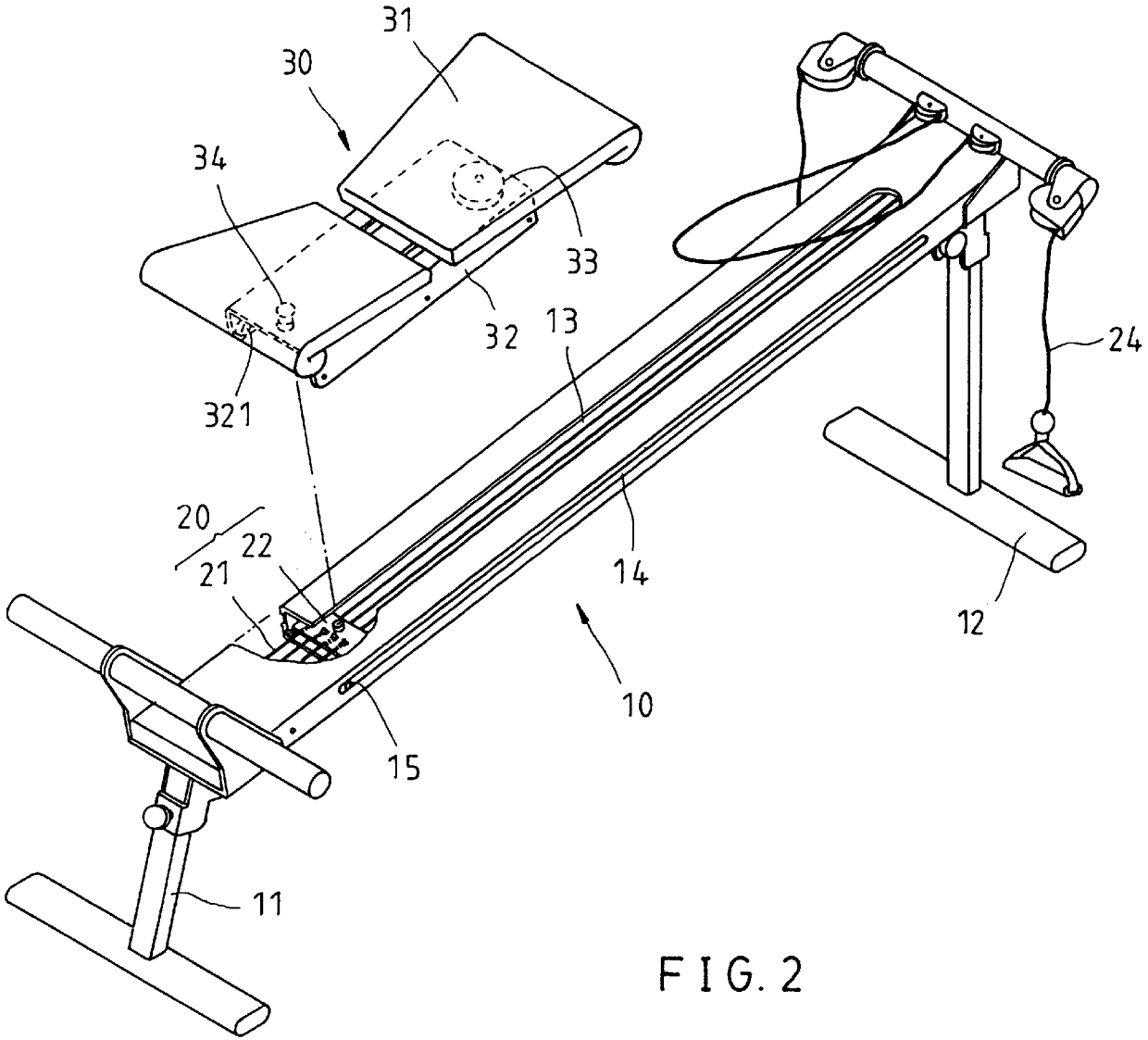
FIG. 2 shows an exploded view of a preferred embodiment of the present invention.
Figure 3:
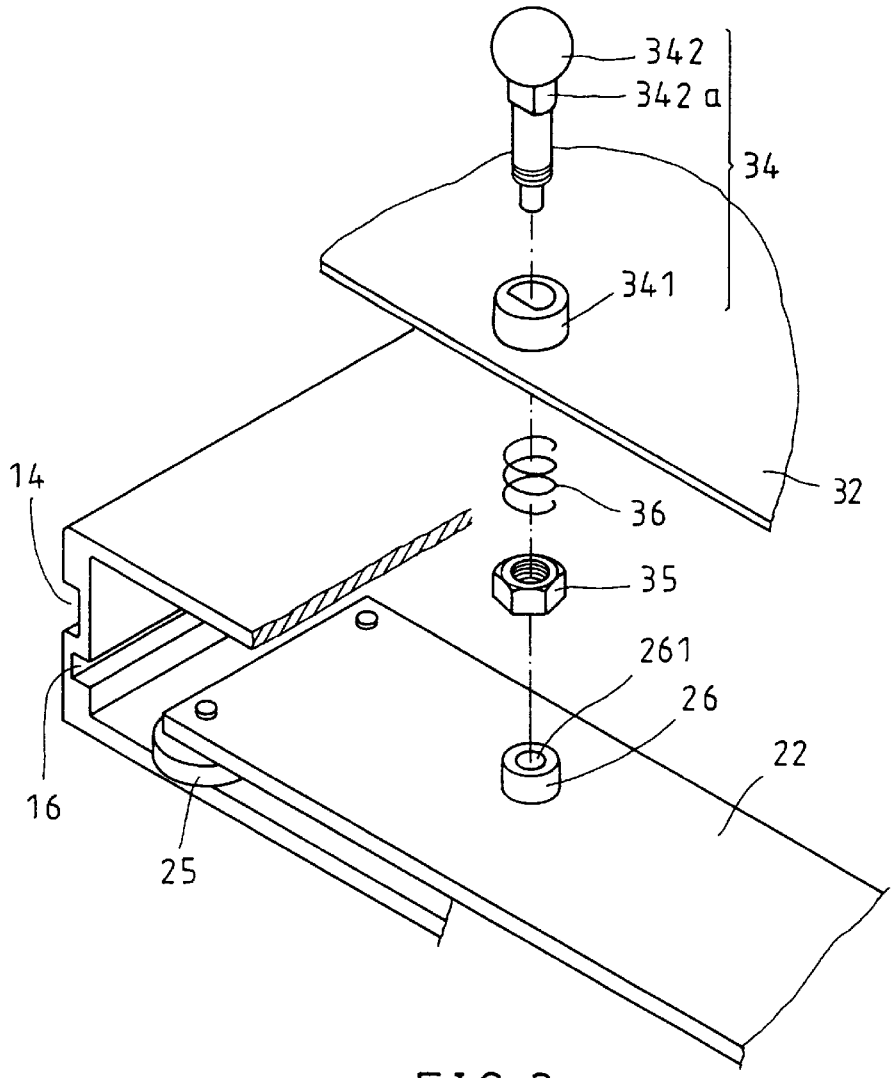
FIG. 3 shows a partial enlarged view of the preferred embodiment of the present invention.
Figure 4:
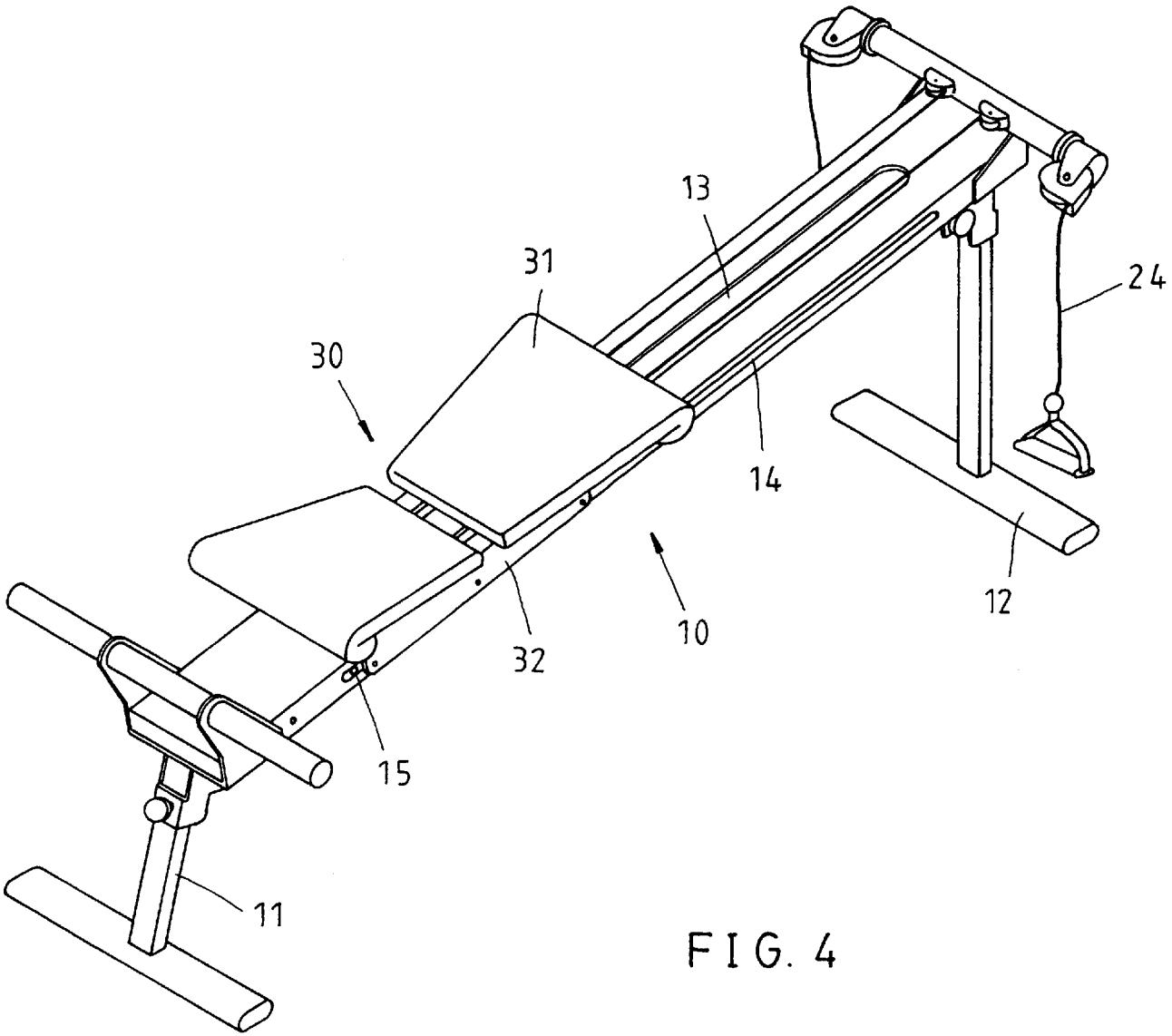
FIG. 4 shows a perspective view of the preferred embodiment of the present invention in combination.

As shown in FIGS. 2–4, an exercise machine embodied in the present invention comprises a frame 10 which is provided with a load mechanism 20. The load mechanism 20 has at least one damping member 21 which is connected with a slide member 22. The damping member 21 is fastened at one end thereof with the rear section of the frame 10 such that other end of the damping member 21 is wound on a slide wheel 23 before being fastened with the slide member 22. The damping member 21 is an elastic cord. The slide member 22 is capable of sliding back and forth between a first position located in the front section of the frame 10, and a second position located in the rear section of the frame 10. The frame 10 is further provided with a pull cord 24.

The exercise machine of the present invention is characterized by the frame 10 which is a hollow rectangular body and is provided in the underside of the front end thereof and the rear end thereof with a front support 11, a rear support 12 greater in height than the front support 11. The frame 10 is thus slanted. The frame 10 is further provided on the upper surface thereof with a position confining slot 13 of a predetermined length and extending along the longitudinal direction of the frame 10. The frame 10 is further provided in the outer wall of two longitudinal sides thereof with a slide slot 14 which is provided in the front section thereof with a press member 15. The frame 10 is further provided in the inner wall of the two longitudinal sides thereof with a guide slot 16.

The present invention is further characterized by the sliding seat pad 30 which is formed of a body 31, a slide seat 32, and a slide wheel 33. The slide seat 32 is of an inverted U-shaped construction and is disposed on the frame 10. The slide seat 32 is provided in the inner wall of two sides thereof with two wheels 321, which are received in the slide slots 14 of the frame 10. The pull cord 24 is wound on the slide wheel 33. As the pull cord 24 is pulled, the sliding seat pad 30 is guided to slide back and forth between the first position contiguous to the front support 11, and the second position contiguous to the rear support 12. The slide seat 32 is provided with a link portion 34 having a semicircular hole 341. A locating pin 342 is received in the semicircular hole 341 and the position confining slot 13 of the frame 10. The locating pin 342 is provided with a columnar section 342*a*, and in the midsection thereof with a nut 35. Located between the underside of the slide seat 32 and the nut 35 is a spring 36 which enables the locating pin 342 to return to locate.

The present invention is further characterized by the slide member 22 which is of a rectangular construction and is disposed in the frame 10. The slide member 22 is provided in the underside thereof with two guide wheels 25 which are received in the guide slots 16 of the frame 10. The slide member 22 is provided with a traction portion 26 corresponding in location to the link portion 34 of the sliding seat pad 30. The traction portion 26 is provided with a round hole 261 into which the lower section of the locating pin 342 is inserted.

Figure 5:
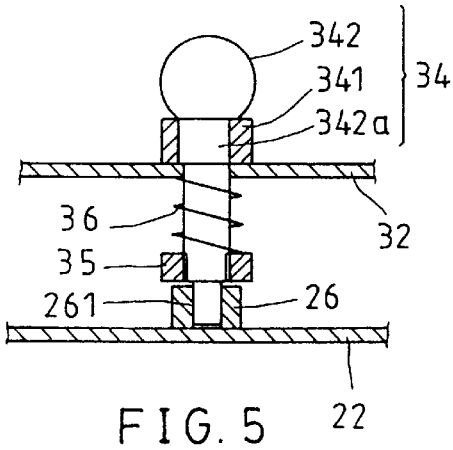
FIG. 5 shows a schematic view of the linking relationship between the sliding seat pad and the slide member of the preferred embodiment of the present invention.
Figure 6:
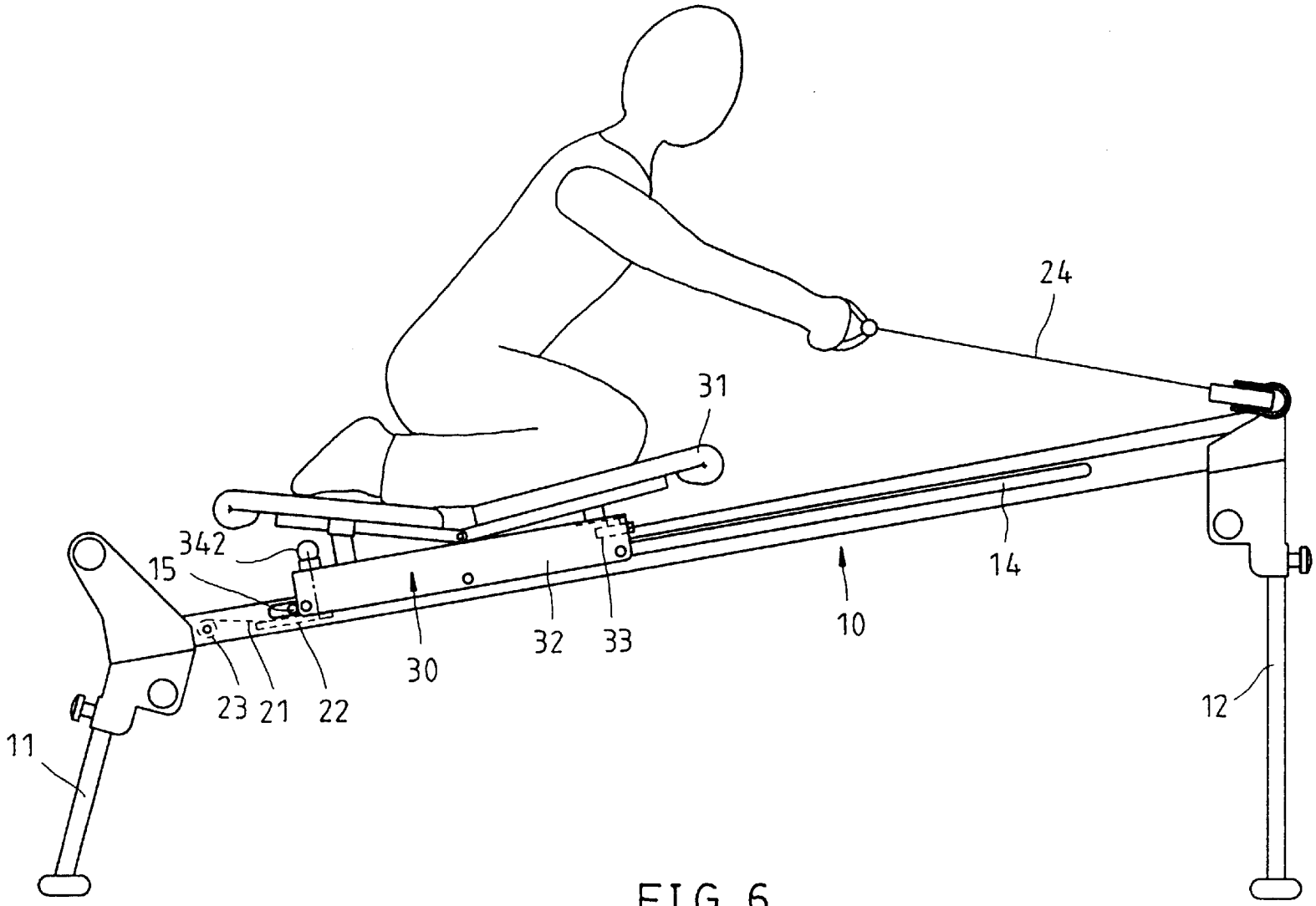
FIGS. 6 and 7 are schematic views of the preferred embodiment of the present invention at work.
Figure 7:
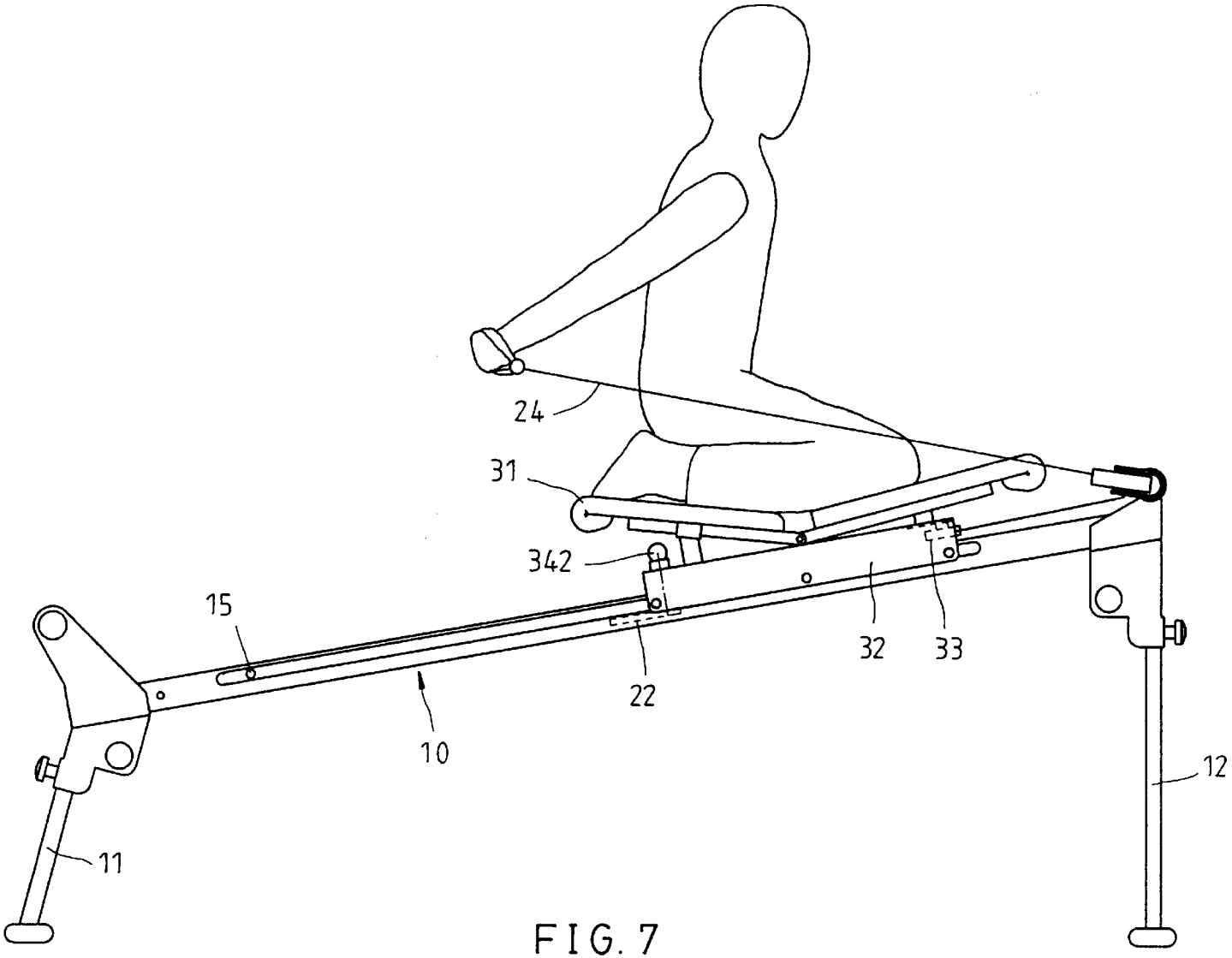

As shown in FIG. 5, when the lower section of the locating pin 342 of the sliding seat pad 30 is received in the round hole 261 of the slide member 22, the slide member 22 is actuated to displace along with the sliding seat pad 30 at the time when the pull cord 24 is pulled. Now referring to FIG. 6, an exerciser is shown doing exercise by kneeling on the pad body 31. The slide member 22 is acted on by the damping member 21 to locate at the front section of the frame 10. In the meantime, the wheels 321 come in contact with the press members 15 located in the slide slots 14. The sliding seat pad 30 is thus located at the first position of the frame 10. As shown in FIG. 7, when the pull cord 24 is exerted on by a force greater than the total pull force of the damping member 21, the sliding seat pad 30 and the slide member 12 are caused to slide toward the second position (rear section) of the frame 10. As the external force exerting on the pull cord 24 becomes smaller than the total pull force of the damping member 21, the slide member 22 returns to its original position. The exercising effect is brought about by pulling the pull cord 24 repeatedly. The magnitude of load can be adjusted by changing the number of the damping member 21.

Figure 8:
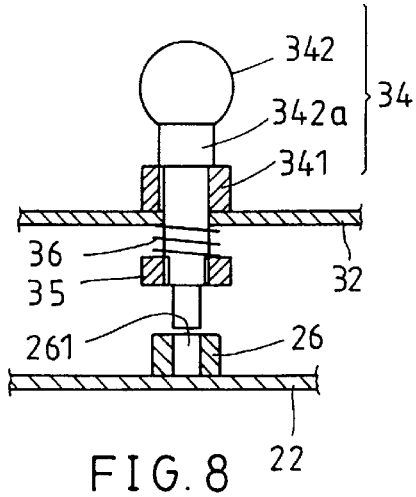
FIG. 8 shows a schematic view of the sliding seat pad which is no longer linked with the slide member of the preferred embodiment of the present invention.
Figure 9:
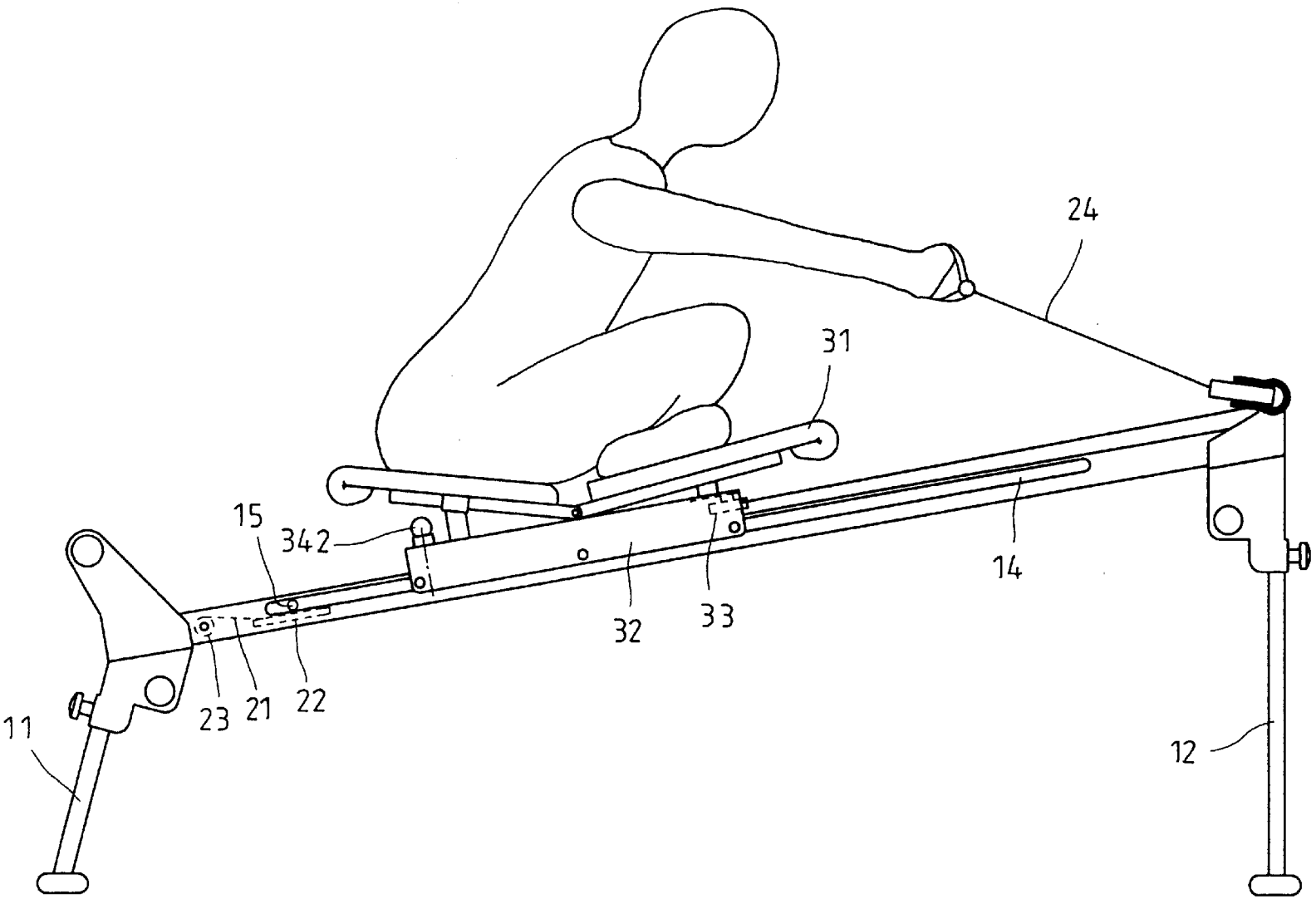
FIGS. 9 and 10 are schematic views of the preferred embodiment of the present invention in action.
Figure 10:
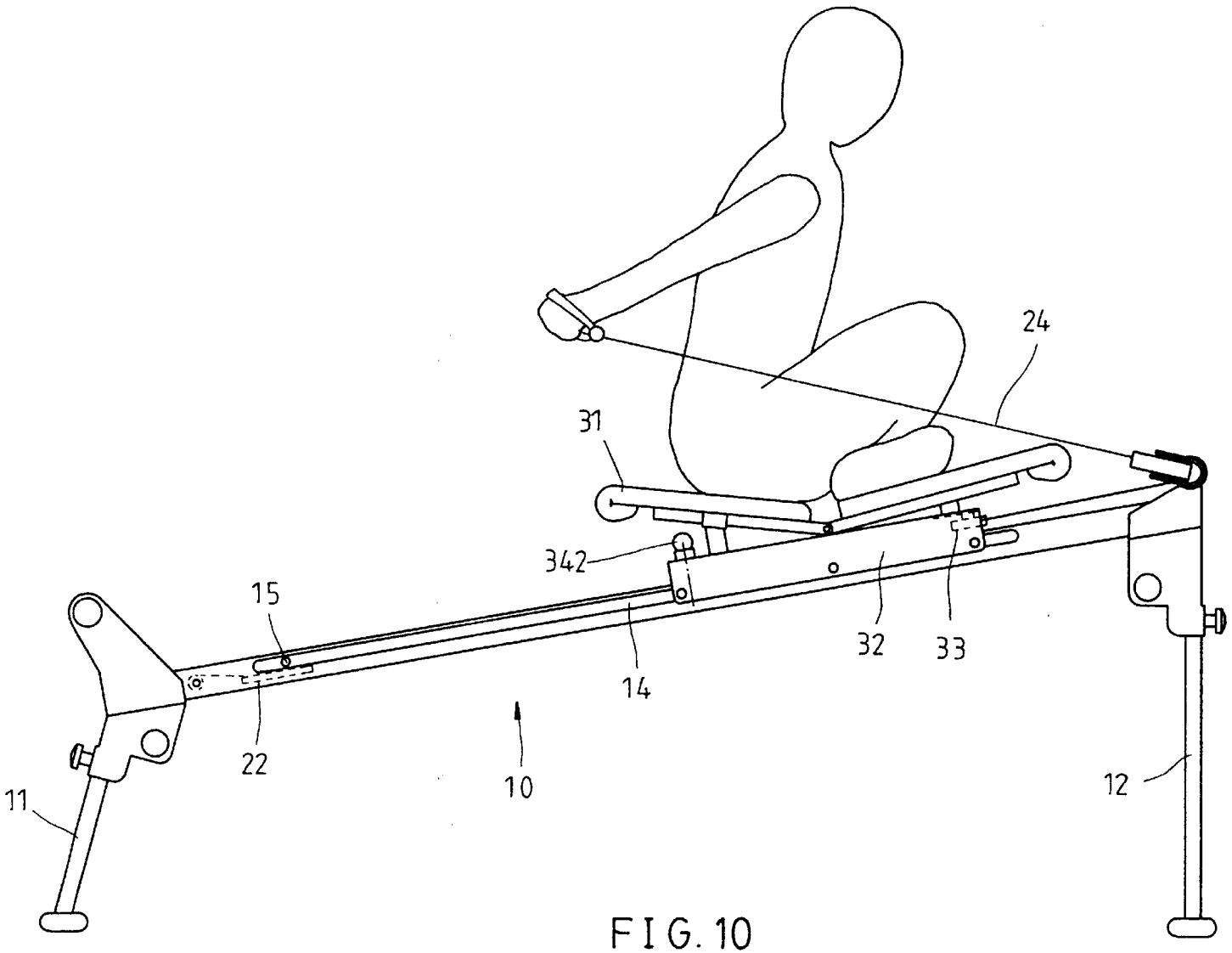

As shown in FIG. 8, when the locating pin 342 is lifted to turn an angle such that the columnar section 342*a* thereof presses against the semicircular hole 341, and that the lower section of the locating pin 342 moves out of the round hole 261, thereby resulting in the separation of the sliding seat pad 30 from the slide member 22. As shown in FIGS. 9 and 10, an exerciser is seated such that the exerciser faces the rear support 12, and that the exerciser's feet are located on the pad body 31. As the pull cord 24 is pulled by the exerciser, the sliding seat pad 30 is caused to slide back and forth between the first position and the second position of the frame 10. However, the sliding seat pad 30 is not provided with a load of the damping member 21. In view of the frame 10 being slanted, the sliding seat pad 30 is forced to move back to its original position by the weight of the exerciser as soon as the pull cord 24 is relieved of the pull force exerting thereon.

The coupling of the link portion 34 of the sliding seat pad 30 with the traction portion 26 of the slide member 22 may be attained by other means, such as a fastening pin, or hooks.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An exercise machine comprising a frame provided with a load mechanism which is formed of at least one damping member and a slide member whereby said slide member is mounted on said frame to slide back and forth between a first position and a second position on said frame, said frame further provided with a pull cord; wherein said frame is further provided with a sliding seat pad which is provided in the underside thereof with a slide wheel connected with said pull cord whereby said pull cord is pulled to actuate said sliding seat pad to slide between said first position and said second position, said sliding seat pad further provided with a link portion; and wherein said slide member is provided with a traction portion to couple and uncouple with said link portion of said sliding seat pad, wherein said slide member and said sliding seat may slide independently of each other on said frame when said traction portion and link portion are uncoupled, and wherein said slide member and said sliding seat may slide together on said frame when said traction portion and link portion are coupled.

2. The exercise machine as defined in claim 1, wherein said frame is of a hollow rectangular construction and is provided in an outer wall of two sides thereof with a slide slot; and wherein said sliding seat pad is formed of a body and, a slide seat of an inverted U-shaped body and mounted on said frame, said slide seat provided in an inner wall of two sides thereof with at least one wheel whereby said wheel is slidably received in said slide slot to guide said sliding seat pad to slide securely on said frame.

3. The exercise machine as defined in claim 1, wherein said frame is of a hollow rectangular construction and is provided in an inner wall of two sides thereof with a guide slot; and wherein said slide member is of a rectangular construction and is received in said frame, said slide member provided in an underside thereof with two guide wheels which are slidably received in said guide slots of said frame.

4. The exercise machine as defined in claim 1, wherein said frame is of a hollow rectangular construction and is provided in an upper surface thereof with a position confining slot of a length and extending along the direction of a longitudinal axis of said frame; wherein said sliding seat pad is formed of a body and a slide seat having said link portion and a semicircular hole in which a locating pin is received such that said locating pin is also received in said position confining slot of said frame, and that said locating pin is fitted into a spring which is located on a midsection of said locating pin by a nut in such a manner that said spring is located between an underside of said slide seat and said nut, said locating pin provided in an upper section thereof with a columnar section; and wherein said traction portion of said slide member is provided with a hole for receiving said locating pin so as to enable said slide member to actuate said sliding seat pad to displace.

5. The exercise machine as defined in claim 1, wherein said frame is provided in an underside thereof with a front support and a rear support greater in height than said front support.

6. The exercise machine as defined in claim 2, wherein said slide slot of said frame is provided in a front end thereof with a press member for locating said sliding seat pad at said first position.

7. The exercise machine as defined in claim 1, wherein said damping member is fastened at one end thereof with a rear section of said frame such that other end of said damping member is fastened with said slide member.

* * * * *